US010465973B2

(12) United States Patent
Gomoll et al.

(10) Patent No.: US 10,465,973 B2
(45) Date of Patent: Nov. 5, 2019

(54) INNER PART FOR A REFRIGERATING DEVICE

(75) Inventors: Günter Gomoll, Elchingen (DE); Günther Hahn, Giengen (DE); Mario Kaiser, Waldstetten (DE); Hans-Markus Roth, Giengen (DE); Manfred Strobel, Langenau (DE)

(73) Assignee: BSH Hausgeräte GmbH, Munich (DE)

( * ) Notice: Subject to any disclaimer, the term of this patent is extended or adjusted under 35 U.S.C. 154(b) by 1879 days.

(21) Appl. No.: 10/926,421

(22) Filed: Aug. 25, 2004

(65) Prior Publication Data

US 2005/0042247 A1 Feb. 24, 2005

Related U.S. Application Data

(63) Continuation of application No. PCT/EP03/01135, filed on Feb. 5, 2003.

(30) Foreign Application Priority Data

Feb. 25, 2002 (DE) ..... 102 08 066

(51) Int. Cl.
*A47B 96/04* (2006.01)
*F25D 23/06* (2006.01)
*F25D 17/04* (2006.01)

(52) U.S. Cl.
CPC ..... *F25D 23/066* (2013.01); *F25D 17/042* (2013.01); *F25D 2317/0415* (2013.01)

(58) Field of Classification Search
CPC ..... F25D 23/066; F25D 17/042; F25D 2317/0415
USPC ..... 417/356; 62/497, 408; 428/411.1
See application file for complete search history.

(56) References Cited

U.S. PATENT DOCUMENTS

| | | | | | |
|---|---|---|---|---|---|
| 2,104,219 | A | * | 1/1938 | Bloom | 62/140 |
| 2,245,737 | A | | 6/1941 | Tandberg et al. | |
| 4,759,599 | A | | 7/1988 | Yamaguchi et al. | |
| 4,775,585 | A | * | 10/1988 | Hagiwara et al. | 428/323 |
| 4,938,958 | A | | 7/1990 | Niira et al. | |
| 4,949,847 | A | * | 8/1990 | Nagata | B65D 81/24 206/484.1 |
| 4,999,210 | A | * | 3/1991 | Solomon et al. | 427/2.25 |
| 5,085,416 | A | * | 2/1992 | Miyake et al. | 269/289 R |
| 5,468,738 | A | | 11/1995 | Okabayashi et al. | |
| 5,556,699 | A | | 9/1996 | Niira et al. | |
| 5,935,717 | A | | 8/1999 | Oishi et al. | |
| 6,164,739 | A | | 12/2000 | Schulz et al. | |

FOREIGN PATENT DOCUMENTS

| | | | | | |
|---|---|---|---|---|---|
| DE | 19712140 | A1 | | 9/1998 | |
| EP | 0006682 | A2 | | 1/1980 | |
| EP | 0 228 063 | B1 | | 7/1987 | |
| EP | 0 270 129 | B1 | | 6/1988 | |
| EP | 0629498 | A1 | | 12/1994 | |
| GB | 2294900 | A | | 5/1996 | |
| GB | 2 330 835 | A | | 5/1999 | |
| JP | S6238721 | A | | 2/1987 | |
| JP | 63-83576 | | | 4/1988 | |
| JP | 05148414 | A | | 6/1993 | |
| JP | 06073196 | A | | 3/1994 | |
| JP | 07071869 | A | | 3/1995 | |
| JP | 11056993 | A | | 3/1999 | |
| JP | 2001235265 | A | | 8/2001 | |
| NL | 9201937 | A | | 6/1994 | |
| WO | 9947595 | | | 9/1999 | |
| WO | WO 9947595 | A1 | * | 9/1999 | C08K 3/00 |
| WO | WO 00/64259 | | * | 4/2000 | |
| WO | 00/64259 | | | 11/2000 | |
| WO | 0073552 | A1 | | 12/2000 | |

OTHER PUBLICATIONS

Merriam Webster NPL document, retrieved May 31, 2016.*
Simona—Product Information.
IONPURE Leaflet.
IONPURE data sheet.

* cited by examiner

*Primary Examiner* — Michael B Nelson
(74) *Attorney, Agent, or Firm* — Michael E. Tschupp; Andre Pallapies; Brandon G. Braun

(57) ABSTRACT

An inner part for a refrigerating device, such as an inner wall, a refrigerating item support, or similar item ideally should be easy to clean. At least a surface of the inner part is provided with effective protection against microbes and/or fungi. Because the inner part inhibits the growth of microbes and/or fungi, it is easier to clean and maintain.

6 Claims, No Drawings

INNER PART FOR A REFRIGERATING DEVICE

CROSS-REFERENCE TO RELATED APPLICATIONS

This application is a continuation, under 35 U.S.C. § 120, of copending international application No. PCT/EP03/01135, filed Feb. 5, 2003, which designated the United States; this application also claims the priority, under 35 U.S.C. § 119, of German patent application No. 102 08 066.6, filed Feb. 25, 2002; the prior applications are herewith incorporated by reference in their entirety.

BACKGROUND OF THE INVENTION

Field of the Invention

The present invention relates to an inner part for a refrigerating device. Such an inner part is understood here as meaning any desired individual part of the refrigerating device that forms part of the delimitation of the cooled interior space of the refrigerating device or is fitted in this interior space.

The moist atmosphere in the interior space of such a refrigerating device, in particular in the case of refrigerators, and precipitating condensation encourage the growth of bacteria, mold or other fungi, which can leave unappetizing dark deposits at points of the refrigerating device that are difficult to reach and clean.

When configuring a refrigerating device, it is generally endeavored to form the surfaces of the interior space as far as possible without joints and sharp angles, so that the user can remove such deposits when they form with as little effort as possible. However, such joints cannot be avoided entirely, in particular at points where various inner parts of the refrigerating device abut one another. The cleaning of such joints is extremely work-intensive.

SUMMARY OF THE INVENTION

It is accordingly an object of the invention to provide an inner part for a refrigerating device which overcomes the above-mentioned disadvantages of the prior art devices of this general type, with which it is possible to prevent the formation of such deposits from the outset, and a method for its production.

With the foregoing and other objects in view there is provided, in accordance with the invention, an inner part for a refrigerating device. The inner part contains a body having a surface with a finish effective against microbes and/or fungi.

The chemical finish makes the surface of the inner part according to the invention unsuitable as a carrier for bacteria, mold, fungi, etc; they are killed or at least inhibited in their development to the extent that no visible deposits can form.

In order to keep down the costs for a finish that inhibits the growth of microbes and/or fungi, preferably only a surface layer of the inner part is provided with a substance that is effective against these.

Such surface coating is particularly expedient in the case of inner parts that are thermoformed or extruded.

Alternatively, an inner part may also be produced according to the invention as one part from a material that is provided with a chemical substance that is effective against microbes and/or fungi. This is particularly expedient in the case of injection-molded parts.

The effective substance is in both cases preferably embedded in a polymer matrix. Preferably used as substances that are effective against microbes are silver compounds and/or zeolites in which metal ions that are effective against microbes and/or fungi, such as silver, zinc or copper for example, are interchangeably bonded. Such zeolites are described in European Patent EP 0 270 129 B1, corresponding to U.S. Pat. No. 4,938,958, and synthetic resin compositions provided with them in European Patent EP 0 228 063 B1, corresponding to U.S. Pat. No. 4,759,599.

According to a first embodiment of the invention, the production of an inner part provided with a finish against microbes and/or fungi includes the steps of applying to a work piece a surface layer which is provided with a finish that is effective against microbes and/or fungi and deforming the work piece to obtain the inner part with a desired shape. The sequence of the two steps is in principle arbitrary; for example, the surface layer may be applied, by dipping, brushing, spraying etc., to a work piece already brought into the shape of the inner part. However, it is preferred for the work piece to be deformed only after the surface layer has been applied, since techniques which can be handled easily and inexpensively, such as coextrusion, lamination of the work piece with a film forming the surface layer etc., can be used for applying the surface layer.

According to a second embodiment of the method according to the invention, the production of the inner part includes the steps of producing material granules mixed with a substance that is effective against bacteria and/or fungi in a desired concentration and injection-molding the granules obtained in this way in order to obtain the finished inner part.

The desired concentration values that are required for achieving a microbicidal or fungicidal effect are very low, so that it may be difficult to accomplish the desired concentration values by direct mixing of the substance with material granules. Therefore, preliminary granules, which contain the effective substance in a concentration that is higher than the desired concentration, are preferably prepared first, and the preliminary granules are mixed with granules that are substantially free from the substance, in order in this way to obtain material granules with the desired concentration.

The preparation of the preliminary granules preferably takes place by mixing the substance with material in the molten state and granulating the mixture obtained in this way.

Other features which are considered as characteristic for the invention are set forth in the appended claims.

Although the invention is described herein as embodied in an inner part for a refrigerating device, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

PREFERRED EMBODIMENT OF THE INVENTION

A refrigerating device, such as for example a refrigerator, contains a heat-insulating housing, which surrounds a cooled interior space and can be closed with a door. The housing and the door are constructed in the same way from an outer wall, for example made of painted sheet metal, an inner wall, which is generally produced by thermoforming from flat plastics material, and an insulating foam filling introduced into an intermediate space between the inner wall and the outer wall. Since this construction is generally known, it need not be explained here on the basis of a figure.

In the case of a refrigerator according to the invention, the inner wall of the housing and of the door are provided with a finish that is effective against microbes and/or fungi. The inner wall has a two-layer structure, with a carrier layer that is substantially free from the effective chemical substance, which is facing the insulating foam layer, and a surface layer that is provided with the chemical substance, which is facing the interior space of the refrigerating device.

For producing the inner wall, first a sheet of flat plastic material is produced by coextrusion of two batches of raw material. One batch, forms a carrier layer, of a plastic material or a material mixture which is substantially free from the effective chemical substance, i.e. if it contains the substance at all it is in trace amounts that are not adequate for a microbicidal or fungicidal effect, and a second batch, which contains the same plastic material or material mixture provided with the effective chemical substance, and forms the surface layer.

Examples of suitable effective chemical substances are described in detail in European Patent EP 0 270 129 B1, corresponding to U.S. Pat. No. 4,938,958, which is hereby incorporated by reference herein. Synthetic resin compositions provided with such substances and also concentrations of the effective substances that are suitable for a microbicidal or fungicidal effect are discussed in European Patent EP 0 288 063 B1, corresponding to U.S. Pat. No. 4,759,599, which is hereby incorporated by reference herein. The exemplary embodiments described in these documents are suitable as effective chemical substances or as materials for the production of the surface layer within the scope of the present invention.

The flat material sheet is thermoformed in a way known per se and divided up to form housing or door inner walls. The thickness of the surface layer produced during the coextrusion is dimensioned such that a closed surface layer with a material thickness required for a sustained microbicidal and/or fungicidal effect is retained even after thermoforming.

The interior space of the refrigerating device contains various internal fittings, such as for instance refrigerated-item supports for mounting on the housing, refrigerated-item supports for mounting on the door inner wall, pull-out boxes, trays, etc. The refrigerated-item supports mounted on the housing are made up of glass plates that are enclosed in frame elements made of plastic. These frame elements may be injection-molded parts fitted onto the edges of the plate or be formed directly on the edges of the plate by encapsulation. The pull-out boxes and other boxes and trays fitted in the interior space of the refrigerator, the refrigerated-item supports mounted in the door and other accessories are injection-molded parts made of plastic.

These frame elements and other injection-molded parts may be produced from synthetic resin compositions, as described in the exemplary embodiments of European Patent EP 0 228 063 B1 or defined in the patent claims of this document.

In the production of these injection-molded parts, first a portion of polymer granules is melted and mixed in the molten state with a portion of the chemical substance that is effective against microbes and/or fungi. The portion is dimensioned such that the concentration of the substance in the mixture is a multiple of the concentration desired in the finished injection-molded parts.

The mixture obtained in this way is granulated with a grain size that corresponds to the granules originally used. The granules obtained in this way, referred to as preliminary granules, are mixed with granules that are free from the substance in such a ratio that granules with the concentration configured for the finished inner parts result. Since the grain size of the granules introduced into the mixture is the same and the concentration of the substance in the preliminary granules is so low that the densities of the granules also do not markedly differ, a stable mixture without any segregation tendency is obtained. The mixture is used in a way known per se for producing the inner parts by injection-molding.

We claim:

1. A refrigerating appliance, comprising:

a housing encompassing an interior space of the refrigerating appliance, the housing including an outer wall, an inner wall, and an insulating foam layer in an intermediate space between the inner wall and the outer wall, the inner wall facing the interior space, the inner wall having a first layer of material that includes a plastic material and an admixture with a silver compound effective against at least one of microbes or fungi in the interior space of the refrigerating appliance, the first layer forming a surface layer of the inner wall, and a second layer of material, the second layer of material consists of the same plastic material as the first layer, the second layer of the inner wall facing the insulating foam layer.

2. The refrigerating appliance of claim 1, wherein the first layer and the second layer are bonded together by coextrusion of the first layer and the second layer.

3. The refrigerating appliance of claim 1, wherein the silver compound includes silver ions bonded in a zeolite material.

4. A refrigeration appliance, comprising:

a housing having an outer wall, an inner wall, and an insulating foam layer in an intermediate space between the inner wall and the outer wall, the housing encompassing an interior space of the refrigeration appliance, wherein the inner wall has a surface layer and a carrier layer, the surface layer facing the interior space of the refrigeration appliance and the carrier layer facing the insulating foam layer; and is made from a divided-up plastics sheet material, the divided-up plastics sheet material being made by coextrusion of a first raw material charge and a second material charge;

wherein the first raw material charge forms the surface layer of the inner wall and the second raw material charge forms the carrier layer of the inner wall;

wherein the first raw material charge is made of one of a plastics material and a plastics material mixture;

wherein the second material charge consists of the same plastics material as the first raw material charge;

wherein the first raw material charge is admixed with a silver compound, the silver compound being effective against at least one of microbes or fungi in the interior space of the refrigeration appliance; and wherein the second raw material charge is free of the silver compound.

5. The refrigeration appliance of claim 4, wherein the plastics material comprises a polymer matrix, wherein the silver compound is embedded in the polymer matrix.

6. The refrigeration appliance of claim 4, wherein the plastics material comprises a zeolite material, wherein ions of the silver compound are interchangeably bonded in the zeolite material.

* * * * *